US007237628B2

(12) United States Patent
Desai et al.

(10) Patent No.: US 7,237,628 B2
(45) Date of Patent: Jul. 3, 2007

(54) FIXED CUTTER DRILL BIT WITH NON-CUTTING EROSION RESISTANT INSERTS

(75) Inventors: Neerali Janubhai Desai, Houston, TX (US); Jiinjen Albert Sue, The Woodlands, TX (US)

(73) Assignee: ReedHycalog, L.P., Houston, TX (US)

( * ) Notice: Subject to any disclaimer, the term of this patent is extended or adjusted under 35 U.S.C. 154(b) by 141 days.

(21) Appl. No.: 11/163,529

(22) Filed: Oct. 21, 2005

(65) Prior Publication Data

US 2007/0089913 A1 Apr. 26, 2007

(51) Int. Cl.
*E21B 10/43* (2006.01)

(52) U.S. Cl. ..... 175/406; 175/426; 175/431; 408/18

(58) Field of Classification Search ..... 175/307, 175/313, 396, 406, 424, 426, 429, 431, 432; 408/18; D15/132, 139
See application file for complete search history.

(56) References Cited

U.S. PATENT DOCUMENTS 4,397,361 A * 8/1983 Langford, Jr. ..... 175/428
5,115,873 A * 5/1992 Pastusek ..... 175/65
5,531,281 A * 7/1996 Murdock ..... 175/431
5,992,549 A * 11/1999 Fuller ..... 175/431
6,328,117 B1 * 12/2001 Berzas et al. ..... 175/57
7,128,168 B2 * 10/2006 Youan ..... 175/53
2002/0069725 A1 * 6/2002 Watson et al. ..... 76/108.2

FOREIGN PATENT DOCUMENTS

GB 2086451 A * 5/1982

* cited by examiner

*Primary Examiner*—Kenneth Thompson
(74) *Attorney, Agent, or Firm*—Williams, Morgan & Amerson; Jeffery E. Daly

(57) ABSTRACT

The present invention is directed to a drill bit with non-cutting erosion resistant inserts. In one illustrative embodiment, the apparatus comprises a matrix drill bit body comprising a plurality of blades, a plurality of cutting elements positioned on each of the blades, the cutting elements defining a plurality of web regions, and a plurality of spaced apart, non-cutting erosion resistant inserts positioned along a face of at least one of the blades, at least a portion of each of the non-cutting erosion resistant inserts being positioned in front of one of the web regions.

23 Claims, 4 Drawing Sheets

FIG. 1
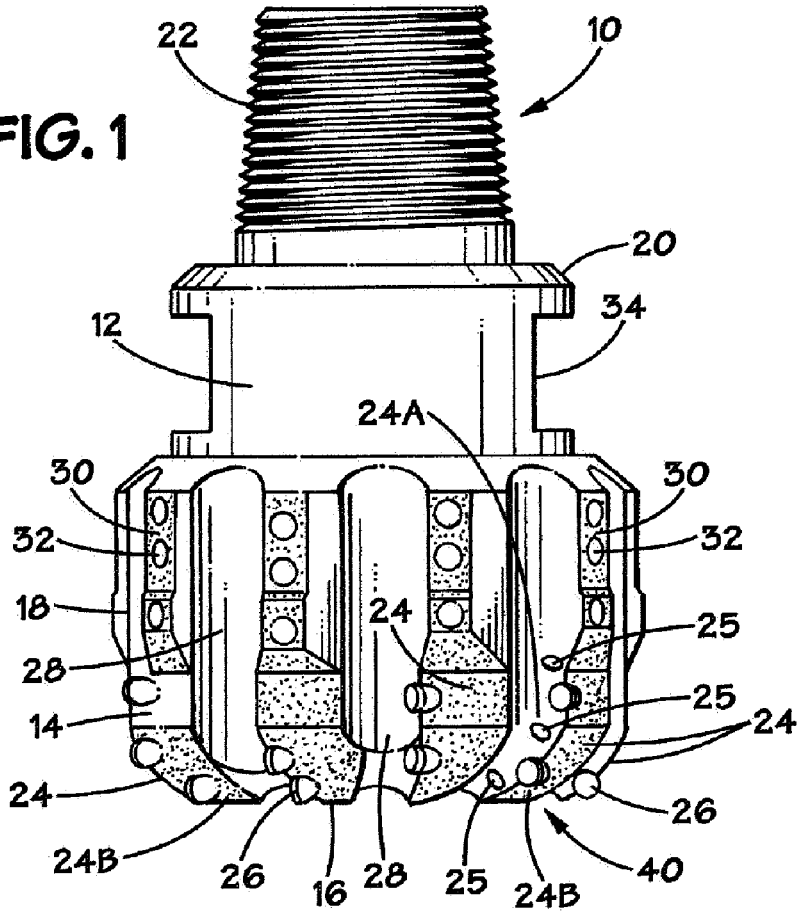
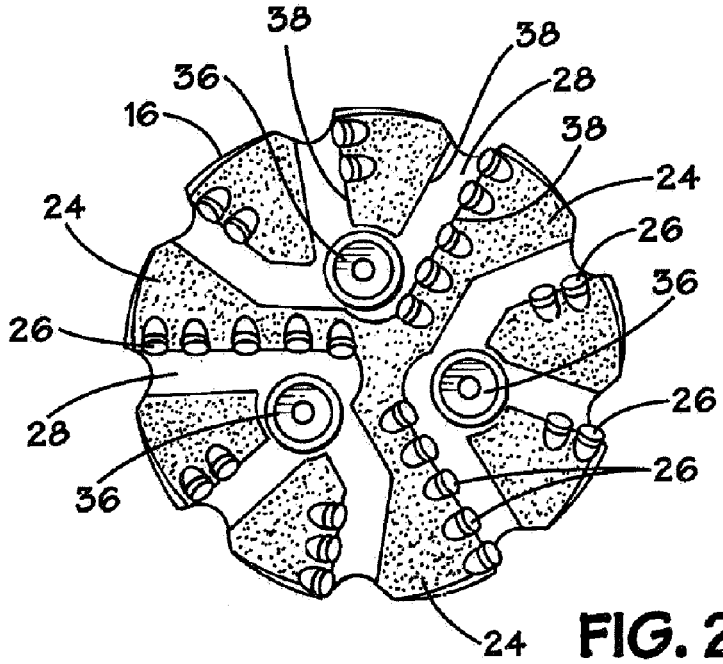
FIG. 2

FIXED CUTTER DRILL BIT WITH NON-CUTTING EROSION RESISTANT INSERTS

BACKGROUND OF THE INVENTION

1. Field of the Invention

The present invention is generally related to the field of drill bits used in drilling oil and gas wells, and, more particularly, to a fixed cutter drill bit with non-cutting erosion resistant inserts.

2. Description of the Related Art

Oil and gas wells are formed by a rotary drilling process. To that end, a drill bit is mounted on the end of a drill string which may be very long, e.g., several thousand feet. At the surface, a rotary drive mechanism turns the drill string and the attached drill bit at the bottom of the hole. In some cases, a downhole motor may provide the desired rotation to the drill bit. During drilling operations, a drilling fluid (so-called drilling mud) is pumped through the drill string and back up-hole by pumps located on the surface. The purpose of the drilling fluid is to, among other things, remove the earthen cuttings resulting from the drilling process.

There are two basic types of earth boring drill bits commonly used to form the boreholes in the earth for mineral exploration and recovery. The first utilizes one or more rolling cutters mounted on a bit body. There are typically several rows of cutting teeth on each cutter. When the bit body is rotated and weight is applied, the teeth on the cutters engage the earth causing the cutters to rotate. As the cutters rotate, the teeth are sequentially pushed into the earth effecting a drilling action. These bits are commonly known as rolling cutter drill bits or rock bits.

The second type of earth boring bit, and the subject of the present invention, utilizes cutting elements fixed on the blades of the bit body. These bits are also rotated, and when weight is applied, the cutting elements are pushed into, and dragged through the earth. This dragging action causes earth removal by shearing. These type of drill bits are generally known as fixed cutter drill bits.

There are different fixed cutter drill bit designs for different drilling applications. For example, a high bladed steel bit (often called a fishtail bit) may be suitable for rapidly drilling through very soft soils and formations, while a polycrystalline diamond compact (PDC) bit may be used to drill through harder rock formations. For very hard and tough rock formations, an infiltrated tungsten-carbide matrix bit body is employed with natural diamond cutting elements. These are typically called diamond or natural diamond drill bits.

As a general rule, drill bits that are able to drill rapidly through soft formations cannot penetrate the harder formations and, similarly, drill bits that are able to drill through harder formations are not aggressive enough to economically drill through softer formations. Thus, when drilling deep wells through many different types of rock and soil, drill bits may have to be changed many times in response to wear or in response to changing soil conditions.

Common to all types of earth drilling bits is a means to flush the drilled earth away from the cutting interface and transport it to the surface. For shallow boreholes, air is a suitable flushing fluid. However, for the deep boreholes commonly drilled for the exploration and production of oil and gas, the flushing fluid is typically a liquid. Because of its color and consistency, this liquid has come to be known as drilling mud or drilling fluid. Although the type of drilling fluid may vary, it typically contains abrasive elements, and it is usually pumped through nozzle orifices on the drill bit, typically at a rate of about 250 500 feet per second.

In rolling cutter drill bits, the primary role of drilling mud is to clean the bit and the bottom of the boreholes and transport the cuttings to the surface. In fixed cutter drill bits with PDC elements, however, the drilling mud has the added critical role of cooling the PDC diamonds. Clearly, diamond, and other suitable forms of superhard materials, are much harder than the earth formations being drilled, so theoretically these materials should not exhibit any wear. However, it is also apparent from examination of used drill bits that the superhard cutting elements do degrade. The degradation of the superhard cutting elements may be caused, at least in part, by the high temperatures generated at the cutting face from the friction of scraping rock. In order to minimize the degradation of the cutting faces, they must be cooled. For maximum cooling (and therefore minimum degradation), it is desirable to have the drilling fluid impinge directly on the cutting elements. However, PDC bits generally have exposed steel or infiltrated matrix surfaces adjacent to the diamond cutting elements, which can rapidly erode in the high velocity, abrasive laden stream of drilling fluid. There are numerous patents which show high velocity drilling fluids directed toward superhard cutting elements in steel bodied PDC drill bits, as shown, for instance, in U.S. Pat. Nos. 4,484,489; 4,907,662; 4,974,994; 4,883,136; 4,452,324; 4,303,136; as well as many others. Unfortunately, directing the flow of drilling fluid in this manner can cause severe erosion of the surfaces adjacent to the cutting elements.

For this reason, the nozzle orifices on PDC drill bits are typically oriented such that high velocity drilling fluid does not directly impinge the diamond cutting elements. Thus, although directing the drilling fluid at the diamond cutting elements on PDC bits would provide better cooling and longer life, commercial drill bits typically do not generally incorporate this feature because of erosion. Instead, the nozzle orifices typically direct the drilling fluid toward the formation at the bottom of the hole, and the splash is used to clean and cool the superhard cutting elements. As a consequence, typical PDC drill bits may not perform well where very high cutting element face friction is present, such as in hard rock drilling.

In addition, where soft, sticky formations are encountered, such as shales with high clay content, the hydraulic action of conventional PDC drill bits is sometimes inadequate to clean the cuttings away from the bit body and the cutting elements resulting in a phenomenon known as bit balling. Most drilling applications allow for between 100 hydraulic horsepower (HHP) and as much as 800 HHP at the bit. Optimizing the use of this significant source of energy to clean and cool the drill bit requires proper orifice size selection and proper placement of the nozzles, including optimum orientation.

In the past, there have been many different attempts to address the erosion problem described above. One common method to provide erosion resistance is to apply welded hardmetal in thick layers to the surface of the blades of a steel body drill bit. Unfortunately, welded hardmetal can crack as the blades of the PDC drill bit bend in response to the drilling loads. Once a crack starts, the impinging drilling fluid quickly erodes the exposed, soft underlying steel. Applying welded hardmetal is typically a hand-applied process and it is difficult to apply to the sides and bottom of the channels on the cutting face of PDC bits. Because it is a manual process, it is also subject to variation based on human and environmental factors. Once the welded hardmetal is applied, it is generally so thick and uneven that it affects the hydraulic flow of the flushing fluids. The swirls and flow eddies in the wake of these thick, rough layers can make the erosion problem even worse. Finally, the temperature caused by the welding process not only affects the heat treatment of the steel PDC bit bodies, as it can also cause the bodies to warp and even crack due to the thermal stresses. The temperature due to welding may also have a deleterious effect on the diamonds themselves if the DDC cutting elements are brazed prior to performing the welding process.

Another approach to erosion resistance is shown by Radtke in U.S. Pat. No. 4,396,077, herein incorporated by reference. Radtke describes a thick tungsten carbide coating applied to the cutting faces of PDC bit bodies with a high velocity plasma arc flame spray process. This process was considered an improvement over the conventional high velocity flame spray processes known at the time. Unfortunately, the problem with this and all other flame spray type coating processes is that the sprayed particle stream must impinge nearly perpendicular to the surface to be coated to make the coating adhere to the cutting face of the bit body. Although sprayed coatings can provide good erosion protection on some areas of the drill bit, the coating does not adhere well to the blade surfaces that are approximately parallel to the cutting face. PDC bits usually have channels formed in the cutting face for the high velocity flushing fluid. Since these channels usually have vertical walls, spray type coatings do not provide adequate erosion resistance in these areas of the drill bit. Also, a flame spray apparatus is generally a line-of-site type device and its powder coating discharge nozzle is normally located some distance away from the surface being coated. The irregular features on the cutting faces of most PDC bits cause "shadows" which block the spray path, preventing direct impingement by the spray. These limitations greatly reduce the effectiveness of the flame spray processes for producing wear and erosion resistant coatings on PDC bits.

Natural diamond drill bits (also called diamond drill bits) are very old in the drilling industry and provide an alternate way of addressing the wear and erosion problems of fixed cutter drill bits. This type of fixed cutter drill bit is made in an infiltration process. The resulting drill bit is generally referred to as a matrix bit body. In this process, natural diamonds or other very hard fixed cutting elements are inserted into cavities in a mold. Powders of highly wear and erosion resistant materials (typically including tungsten carbide) are then packed into the mold, and an infiltrant, typically a copper alloy, is placed in contact with the powders. The mold with the powders, cutting elements and infiltrant are all placed into a furnace and heated to the melting point of the infiltrant. The melted infiltrant fuses the diamonds and powders into a solid mass. This process produces a unitary body of infiltrated tungsten carbide and fixed cutting elements with improved wear and erosion resistance. By way of example, an early diamond drill bit design is disclosed in U.S. Pat. No. 2,371,489. It is also possible to form pockets in an infiltrated cutting face and later attach polycrystalline diamond cutters, as shown in U.S. Pat. No. 4,073,354, providing a somewhat more aggressive cutting structure than traditional diamond drill bits. Unfortunately, infiltrated or matrix bits are expensive to manufacture. Each bit must be cast in a mold in a very labor intensive process.

Infiltrated or matrix bit bodies are also weak in bending, so the blade height achievable with an infiltrated product is limited by the intrinsic strength of the material in bending. Therefore, these relatively shorter blades do not penetrate the earth as aggressively as the extended cutting faces of steel PDC drill bits. As a result, matrix drill bits do not provide the very high (and desirable) rates of penetration of PDC bits.

Finally, because the matrix drill bit products use a relatively soft copper based infiltrate to bind the tungsten carbide together, the infiltrated drill bit product can also be subject to erosion as the fluid stream attacks the copper binder, weakening the matrix and allowing tungsten carbide to be loosened from the body. The matrix design provides some erosion improvement over steel, but is still subject to all the limitations described above.

There are also numerous bit designs which are derivatives of either the infiltrated bit process or the coated steel process used in PDC bits. For example, in U.S. Pat. Nos. 4,554,130, 4,562,892 and 4,630,692, all herein incorporated by reference, a cladding process is disclosed for making a PDC type bit with a layer of wear and erosion resistant material. In these patents, a steel blank is coated with a thick layer of powders, the assembly is heated and then transferred to a press where the powders are fused to the steel surface under temperature and pressure with the aid of a ceramic or graphite pressure transfer medium. The layer must be thick, for it must contain a binder along with the wear resistant powder as it is compressed in the press. Although PDC type drill bits are shown and described in these patents, it is impractical to clad the vertical surfaces as shown. This is because the movement of the pressure transfer media tends to scrape the powders from the vertical steel surface as the press closes. Also, because the steel body itself is incompressible, the pressure transfer media will not be able to move in a manner which allows for an even pressure distribution. The end product of the above described cladding process has many of the same deficiencies as the flame spray coatings previously described, in that the vertical surfaces will not have adequate erosion protection.

The present invention is directed to an apparatus and methods for solving, or at least reducing the effects of, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is generally directed to a fixed cutter drill bit with non-cutting erosion resistant inserts. In one illustrative embodiment, the apparatus comprises a matrix drill bit body comprising a plurality of blades, a plurality of cutting elements positioned on each of the blades, the cutting elements defining a plurality of web regions, and a plurality of spaced apart, non-cutting erosion resistant inserts positioned along a face of at least one of the blades, at least a portion of each of the non-cutting erosion resistant inserts being positioned in front of one of the web regions.

In another illustrative embodiment, the apparatus comprises a matrix drill bit body comprising a plurality of blades, a plurality of cutting elements positioned on each of the blades, the cutting elements defining a plurality of web regions, and a plurality of spaced apart, non-cutting erosion resistant inserts positioned along a face of at least one of the blades, each of the non-cutting erosion resistant inserts being positioned in front of and approximately aligned with one of the web regions.

Additionally, the present invention is directed to a method of forming a fixed cutter drill bit comprised of a plurality of blades and a plurality of cutting elements positioned along each of the blades, the cutting elements defining a plurality of web regions. In one illustrative embodiment, the method comprises providing a mold for the fixed cutter drill bit, positioning a plurality of spaced apart, non-cutting erosion resistant inserts in the mold such that the non-cutting erosion resistant inserts will be positioned along a face of at least one of the blades, positioning a plurality of plugs in the mold so as to form pockets for placement of the cutting elements, and introducing a matrix forming particulate material and a binder alloy into the mold.

BRIEF DESCRIPTION OF THE DRAWINGS

The invention may be understood by reference to the following description taken in conjunction with the accompanying drawings, in which like reference numerals identify like elements, and in which:

FIG. 1 is a perspective view of a drill bit in accordance with one illustrative embodiment of the present invention.

FIG. 2 is a bottom view of one illustrative embodiment of the present invention.

Figure 3A:
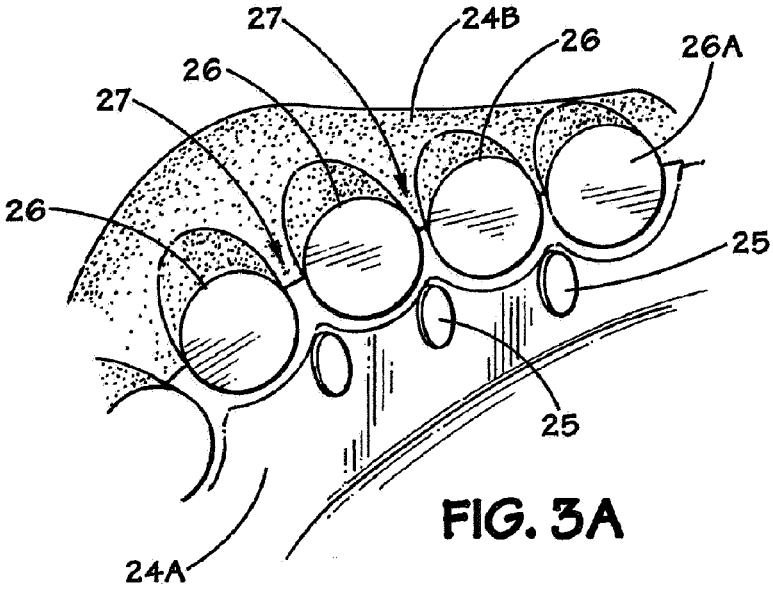
FIGS. 3A-3B are enlarged side views of a portion of a blade of a fixed cutter bit comprised of the non-cutting erosion resistant inserts of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Turning now to the drawings, and referring initially to FIGS. 1 and 2, an exemplary fixed cutter drill bit of the present invention is illustrated and generally designated by the reference numeral 10. The drill bit 10 has a bit body 12 that generally includes a lower end 14 having a cutting face section 16 and a gauge section 18, and an upper end 20 adapted to be secured to a drill string (not shown) by, for example, tapered threads 22. The cutting face section 16 of the bit body 12 includes a number of blades 24 that generally radiate from the central area of the cutting face 16. The blades 24 have a face 24A and an end surface 24B. Advantageously, each of the blades 24 carries a number of cutting elements 26. Each of the cutting elements 26 partially protrude from their respective blade 24 and are spaced apart along the blade 24, typically in a given manner to produce a particular type of cutting pattern. Many such patterns exist which may be suitable for use on the drill bit 10 fabricated in accordance with the teachings provided herein. A cutting element 26 typically includes a preform cutting element that is mounted on a carrier in the form of a stud which is secured within a pocket in the blade 24. Typically, preform cutting elements are circular tablets of polycrystalline diamond compact (PDC) or other suitable superhard material bonded to a substrate of a tungsten carbide, so that the rear surface of the tungsten carbide substrate may be brazed into a suitably oriented surface on the stud which may also be formed from tungsten carbide.

While the cutting face section 16 of the drill bit 10 is responsible for cutting the underground formation, the gauge section 18 is generally responsible for stabilizing the drill bit 10 within the bore hole. The gauge section 18 typically includes extensions of the blades 24 which create channels 28 through which drilling fluid may flow upwardly within the bore hole to carry away the cuttings produced by the cutting face section 16. These blade extensions are typically referred to as kickers, which are illustrated by the reference numeral 30. Each kicker 30 generally includes at least one abrading element 32, such as a tungsten carbide insert or surface, which provides a hard, wear resistant surface to increase the longevity of the kickers 30.

The upper end of the bit body 20 also typically includes breaker slots 34 which are flattened portions of the upper end of the bit body 20 that permit a wrench to be placed on the bit body 10 for installation and removal of the drill bit 10 from a drill string (not shown).

Within the bit body 12 is a passage (not shown) that allows pressurized drilling fluid to be received from the drill string and communicated with one or more orifices 36 located on or adjacent to the cutting face 16. These orifices 36 accelerate the drilling fluid as it passes therethrough. All of the surfaces 40 of the bit body 12 are susceptible to erosive and abrasive wear during the drilling process.

Figure 3B:
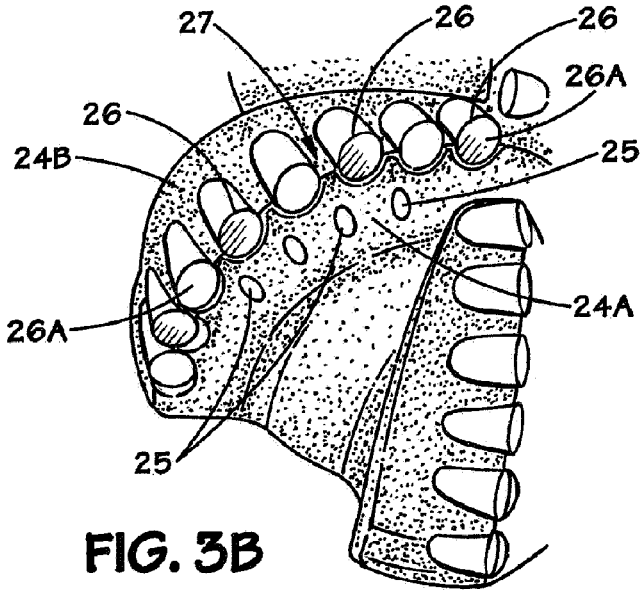
Figure 3C:
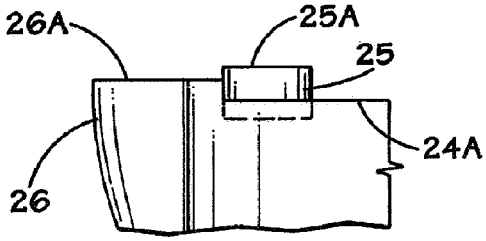
FIG. 3C is a schematic drawing depicting an illustrative relative positioning of the non-cutting erosion resistant inserts of the present invention relative to a cutting surface of a cutting element.

As depicted in FIGS. 3A-3C, in one illustrative embodiment, a non-cutting erosion resistant insert 25 is positioned in front of the web region 27 between adjacent cutting elements 26. The erosion resistant insert 25 is non-cutting in the sense that it is not intended to participate in the cutting of the formation during normal drilling operations. In a more specific illustrative embodiment, a plurality of spaced apart, non-cutting erosion resistant inserts 25 are positioned in the face 24A of each of the blades 24. As described more fully below, the size, shape, configuration and positioning of the non-cutting erosion resistant inserts 25 may vary depending upon the particular application. In the illustrative embodiment depicted herein, the non-cutting erosion resistant inserts 25 have a generally elliptical shape. The non-cutting erosion resistant inserts 25 may also take other forms, for example, substantially conical, oval, round, chisel, spherical, or polyhedron shapes. In one illustrative embodiment, the non-cutting erosion resistant insert 25 is an oval shape. The Rx and Ry dimensions are approximately 0.135 inch and 0.075 inch, respectively. Thus, the present invention should not be considered as limited to any particular size, shape or configuration of the non-cutting erosion resistant inserts 25.

As schematically depicted in FIG. 3C, the non-cutting erosion resistant inserts 25 have a front surface 25A that, in one illustrative embodiment, may protrude beyond the substantially planar cutting surface 26A of the cutting elements 26. In one illustrative example, the front surface 25A of the insert 25 may be positioned approximately ±0.5 inches beyond or beneath the plane of the cutting surface 26A of the cutting element 26. However, the front surface 25A of the non-cutting erosion resistant inserts 25 can be positioned beyond, beneath, or approximately even with the plane of the cutting surface 26A of the cutting elements 26. Typically, the non-cutting erosion resistant inserts 25 will be positioned such that the plane of the surface 25A protrudes approximately 0.01-0.5 inches above the face 24A of the blade 24. In some cases, the protrusion of the front surfaces 25A relative to the surface 24A of the blade 24 will occur or increase as portions of the face 24A of the blade 24 that are approximately parallel to the cutting surfaces 26A wear away during drilling operations.

The non-cutting erosion resistant inserts 25 may be made from a variety of materials. In one illustrative embodiment, the non-cutting erosion resistant inserts 25 may be made from a variety of well-known materials, such as TSP (thermally stabilized polycrystalline diamond compact), natural diamond, cemented tungsten carbide, c BN (cubic boron nitride), Si3N4 (silicon nitride), BC (boron carbide) or superhard coating elements, such as NbN/VN superlattice coating, other superlattice coating and CN coating.

Figure 4:
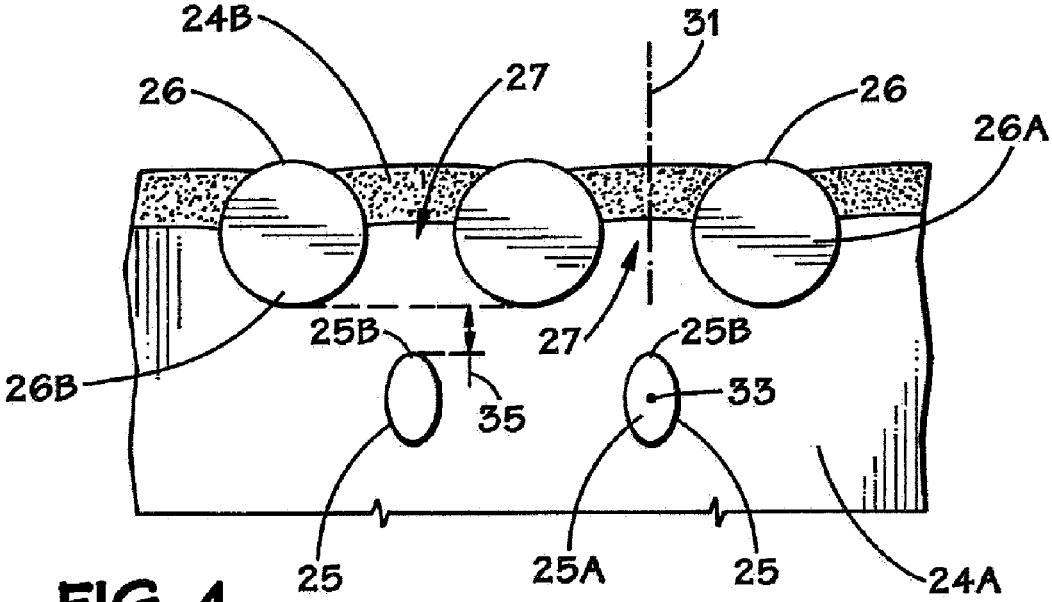
FIG. 4 is an illustrative layout depicting one illustrative example of the relative positioning of the non-cutting erosion resistant inserts and the cutting elements.

The placement of the non-cutting erosion resistant inserts 25 relative to the cutting elements 26 and the web regions 27 may also vary depending upon the particular application. FIG. 4 is a schematic layout of a plurality of cutting elements 26 and a plurality of non-cutting erosion resistant inserts 25. Typically, at least a portion of a non-cutting erosion resistant insert 25 will be positioned in front of a web region 27. In the illustrative layout depicted in FIG. 4, the center 33 of the non-cutting erosion resistant inserts 25 are approximately aligned with the center of the web regions 27 between adjacent cutting elements 26, as indicated by the line 31. Of course, exact geometrical alignment may be difficult due to the curves and contours of the drill bit body and the blades 24. In one illustrative embodiment, a rear edge 25B of the non-cutting erosion resistant inserts 25 are offset from a line between the forward edge 26B of two adjacent cutting elements 26 by a distance 35 that may range from approximately 0.1-1.0 inches, depending upon the particular application and the physical size of the cutting elements 26, the web regions 27 and the non-cutting erosion resistant inserts 25. The orientation of the non-cutting erosion resistant inserts 25 relative to the cutting elements 26 may also vary depending upon the particular application, i.e., the non-cutting inserts 25 may be rotated about themselves and positioned in any desired orientation.

Figure 5:
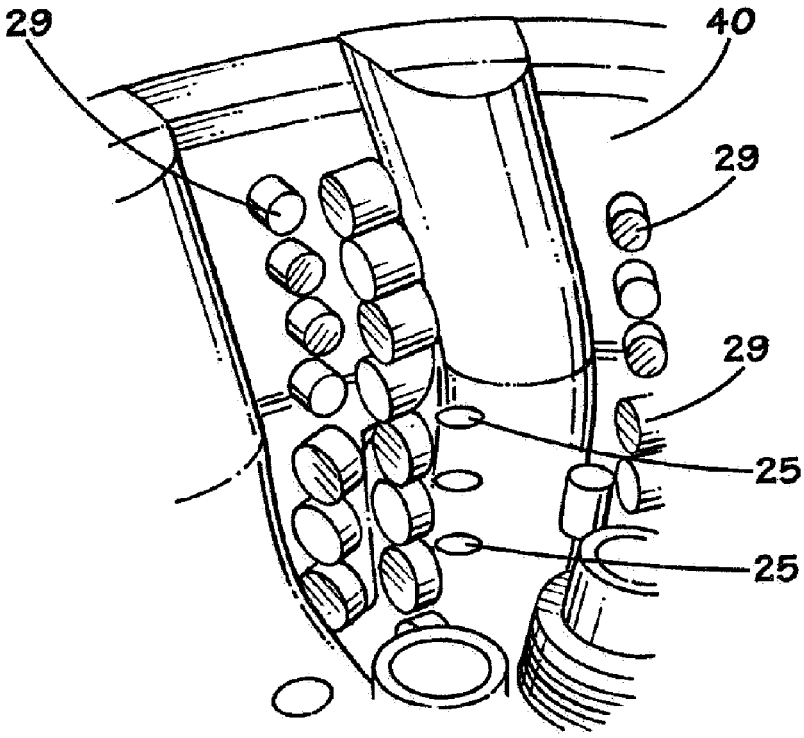
FIG. 5 is a perspective view of a mold that depicts one illustrative example of forming a drill bit in accordance with the present invention.

As mentioned previously, the present invention may be employed with fixed cutter type or matrix drill bit bodies. In one illustrative embodiment, the non-cutting erosion resistant inserts 25 may be formed in the bit body during the molding process used to form a matrix drill bit body. Such matrix bit bodies may be formed by performing well-known powder metallurgy processes. One illustrative method of forming the matrix bit body is described in U.S. Pat. No. 6,148,936, which is hereby incorporated by reference. As shown in FIG. 5, in accordance with one illustrative embodiment, the non-cutting erosion resistant inserts 25 may be positioned in a mold 50 used for forming a matrix drill bit body. A plurality of plugs 29 are also depicted in FIG. 5. The plugs 29 are used to create pockets in the drill bit body wherein cutting elements 26 will eventually be positioned. As is well known to those skilled in the art, the mold 50 is filled with particulate matrix forming material, such as tungsten carbide particles. Thereafter, this matrix forming material is then infiltrated with a binder alloy, usually a copper alloy, in a furnace which is raised to a sufficiently high temperature to melt the infiltration alloy and cause it to infiltrate downwardly through the matrix forming material due to gravity. The matrix material is then allowed to cool to room temperature so that the infiltration alloy solidifies so as to form, with the matrix forming particles, a solid infiltrated matrix bit body.

Figure 6A:
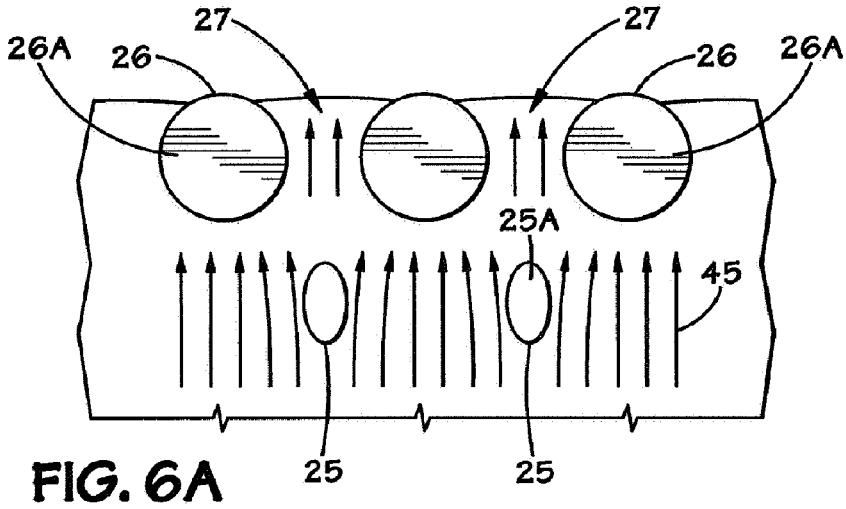
FIGS. 6A-6C are schematic depictions of the flow of drilling fluid through a drill bit incorporating aspects of the present invention.
Figure 6B:
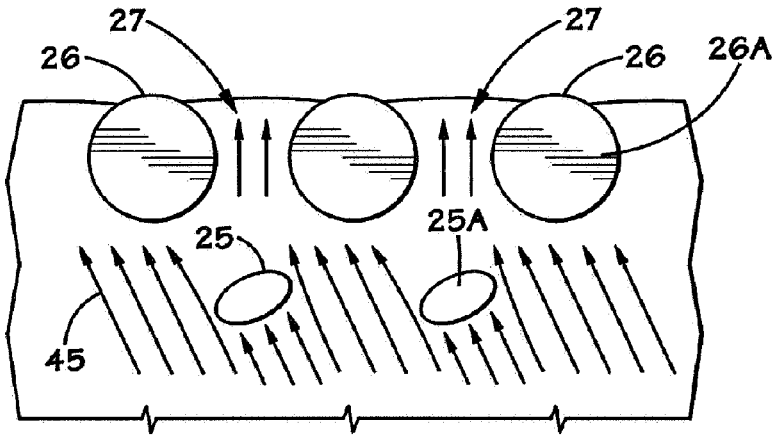
Figure 6C:
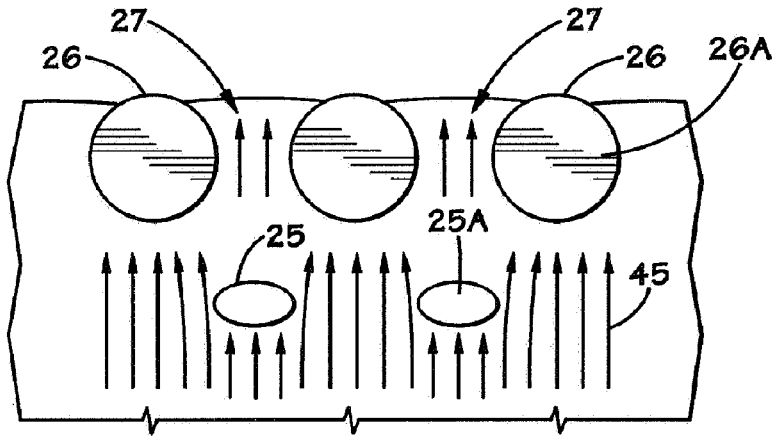

In use, in one illustrative embodiment, the non-cutting erosion resistant inserts 25 are positioned in the face 24A of the blades 24 so as to direct at least some of the flow of drilling fluid toward the cutting surfaces 26A of the cutting elements 26 and away from the web regions 27 between adjacent cutting elements 26. Various illustrative flow paths of drilling fluid are schematically depicted in FIGS. 6A-6C. Due to the presence of the non-cutting erosion resistant inserts 25, the flow stream of drilling fluid 45 concentrates and sweeps across the cutting surfaces 26A of the cutting elements 26. Thus, the cutting surfaces 26A may be cooled and the erosion of the bit body adjacent to the cutting elements 26 and in the web regions 27 between the cutting elements 26 may be reduced.

The present invention is generally directed to a drill bit with non-cutting erosion resistant inserts. In one illustrative embodiment, the apparatus comprises a matrix drill bit body comprising a plurality of blades, a plurality of cutting elements positioned on each of the blades, the cutting elements defining a plurality of web regions, and a plurality of spaced apart, non-cutting erosion resistant inserts positioned along a face of at least one of the blades, at least a portion of each of the non-cutting erosion resistant inserts being positioned in front of one of the web regions.

In another illustrative embodiment, the apparatus comprises a matrix drill bit body comprising a plurality of blades, a plurality of cutting elements positioned on each of the blades, the cutting elements defining a plurality of web regions, and a plurality of spaced apart, non-cutting erosion resistant inserts positioned along a face of at least one of the blades, each of the non-cutting erosion resistant inserts being positioned in front of and approximately aligned with one of the web regions.

Additionally, the present invention is directed to a method of forming a fixed cutter drill bit comprised of a plurality of blades and a plurality of cutting elements positioned along each of the blades, the cutting elements defining a plurality of web regions. In one illustrative embodiment, the method comprises providing a mold for the fixed cutter drill bit, positioning a plurality of spaced apart, non-cutting erosion resistant inserts in the mold such that the non-cutting erosion resistant inserts will be positioned along a face of at least one of the blades, positioning a plurality of plugs in the mold so as to form pockets for placement of the cutting elements, and introducing a matrix forming particulate material and a binder alloy into the mold.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A fixed cutter drill bit, comprising:

a matrix drill bit body comprising a plurality of blades;

a plurality of cutting elements positioned on each of said blades, said cutting elements defining a plurality of web regions; and a plurality of spaced apart, non-cutting erosion resistant inserts positioned along a face of at least one of said blades, at least a portion of each of said non-cutting erosion resistant inserts being positioned in front of one of said web regions.

2. The drill bit of claim 1, wherein said spaced apart, non-cutting erosion resistant inserts are positioned so as to direct at least some of the flow of a drilling fluid away from said web region toward cutting elements adjacent said web region.

3. The drill bit of claim 1, wherein each of said non-cutting erosion resistant inserts comprises a front surface and each of said cutting elements comprises a substantially planar cutting surface and wherein said front surfaces of said non-cutting erosion resistant inserts are positioned within a range of plus or minus 0.5 inches of a plane containing said substantially planar cutting surfaces of said cutting elements.

4. The drill bit of claim 1, wherein each of said non-cutting erosion resistant inserts comprises a front surface and each of said cutting elements comprises a substantially planar cutting surface and wherein said front surfaces of said non-cutting erosion resistant inserts are positioned approximately even with a plane containing said substantially planar cutting surfaces of said cutting elements.

5. The drill bit of claim 1, wherein each of said non-cutting erosion resistant inserts comprise a front surface and wherein each of said front surfaces extend above said face of said blade by a distance of approximately 0.01-0.5 inches.

6. The drill bit of claim 1, wherein a rear edge of said non-cutting erosion resistant insert is offset from a line between a forward edge of two adjacent cutting elements by a distance that ranges from 0.1-1.0 inches.

7. The drill bit of claim 1, wherein said non-cutting erosion resistant inserts are comprised of at least one of TSP (thermally stabilized polycrystalline diamond compact), natural diamond, cemented tungsten carbide, c BN (cubic boron nitride), silicon nitride, boron carbide, and a superhard coating element.

8. The drill bit of claim 1, wherein each of said plurality of non-cutting erosion resistant inserts has at least one of a substantially conical, a substantially elliptical, a substantially round, a substantially spherical, a substantially oval, a substantially chiseled, and a substantially polyhedron shape.

9. The drill bit of claim 1, wherein a rear edge of each of said non-cutting erosion resistant inserts is positioned in front of a line between the forward edge of two adjacent cutting elements.

10. The drill bit of claim 1, wherein a center of each of said non-cutting erosion resistant inserts is approximately aligned with a center of a web region.

11. A fixed cutter drill bit, comprising:

a matrix drill bit body comprising a plurality of blades;

a plurality of cutting elements positioned on each of said blades, said cutting elements defining a plurality of web regions; and a plurality of spaced apart, non-cutting erosion resistant inserts positioned along a face of at least one of said blades, each of said non-cutting erosion resistant inserts being positioned in front of and approximately aligned with one of said web regions.

12. The drill bit of claim 11, wherein said spaced apart, non-cutting erosion resistant inserts are positioned so as to direct at least some of the flow of a drilling fluid away from said web region toward cutting elements adjacent said web region.

13. The drill bit of claim 11, wherein each of said non-cutting erosion resistant inserts comprises a front surface and each of said cutting elements comprises a substantially planar cutting surface and wherein said front surfaces of said non-cutting erosion resistant inserts are positioned within a range of plus or minus 0.5 inches of a plane containing said substantially planar cutting surfaces of said cutting elements.

14. The drill bit of claim 11, wherein each of said non-cutting erosion resistant inserts comprises a front surface and each of said cutting elements comprises a substantially planar cutting surface and wherein said front surfaces of said erosion resistant inserts are positioned approximately even with a plane containing said substantially planar cutting surfaces of said cutting element.

15. The drill bit of claim 11, wherein each of said non-cutting erosion resistant inserts comprise a front surface and wherein each of said front surfaces extend above said face of said blade by a distance of approximately 0.01-0.5 inches.

16. The drill bit of claim 11, wherein a rear edge of said non-cutting erosion resistant insert is offset from a line between a forward edge of two adjacent cutting elements by a distance that ranges from 0.1-1.0 inches.

17. The drill bit of claim 11, wherein said non-cutting erosion resistant inserts are comprised of at least one of TSP (thermally stabilized polycrystalline diamond compact), natural diamond, cemented tungsten carbide, c BN (cubic boron nitride), silicon nitride, boron carbide, and a superhard coating elements.

18. The drill bit of claim 11, wherein a rear edge of each of said non-cutting erosion resistant inserts is positioned in front of a line between the forward edge of two adjacent cutting elements.

19. The drill bit of claim 11, wherein a center of each of said non-cutting erosion resistant inserts is approximately aligned with a center of a web region.

20. A method of forming a fixed cutter drill bit comprised of a plurality of blades, a plurality of cutting elements positioned along each of said blades, said cutting elements defining a plurality of web regions, the method comprising:

providing a mold for said fixed cutter drill bit;

positioning a plurality of spaced apart, non-cutting erosion resistant inserts in said mold such that said non-cutting erosion resistant inserts will be positioned along a face of at least one of said blades;

positioning a plurality of plugs in said mold so as to form pockets for placement of said cutting elements; and introducing a matrix forming particulate material and a binder alloy into said mold.

21. The method of claim 20, wherein said non-cutting erosion resistant inserts are positioned such that at least a portion of each of said non-cutting erosion resistant inserts is positioned in front of one of said web regions.

22. The method of claim 20, wherein said non-cutting erosion resistant inserts are positioned such that said non-cutting erosion resistant inserts are substantially aligned with said web regions.

23. The method of claim 20, wherein said non-cutting erosion resistant inserts are positioned such that a center of said non-cutting erosion resistant inserts is substantially aligned with a center of said web regions.

* * * * *